US010480906B1

(12) United States Patent
Saez et al.

(10) Patent No.: US 10,480,906 B1
(45) Date of Patent: Nov. 19, 2019

(54) ELECTRONIC LOCK FOR MOUNTED FIREARM ACCESSORIES

(71) Applicants: Jorge Saez, Miami, FL (US); Lazaro Jorge Saez, Miami, FL (US)

(72) Inventors: Jorge Saez, Miami, FL (US); Lazaro Jorge Saez, Miami, FL (US)

( * ) Notice: Subject to any disclaimer, the term of this patent is extended or adjusted under 35 U.S.C. 154(b) by 0 days.

(21) Appl. No.: 16/151,209

(22) Filed: Oct. 3, 2018

Related U.S. Application Data

(60) Provisional application No. 62/567,447, filed on Oct. 3, 2017.

(51) Int. Cl.

| | |
|---|---|
| ***F41G 11/00*** | (2006.01) |
| ***E05B 47/06*** | (2006.01) |
| ***E05B 73/00*** | (2006.01) |
| *E05B 47/00* | (2006.01) |

(52) U.S. Cl.
CPC ..... *F41G 11/003* (2013.01); *E05B 47/0603* (2013.01); *E05B 73/00* (2013.01); *E05B 2047/0095* (2013.01)

(58) Field of Classification Search
CPC . F41G 11/003; F41G 1/32; F41G 1/34; F41G 1/35; F41G 1/36
USPC ..... 42/114, 115
See application file for complete search history.

(56) References Cited

U.S. PATENT DOCUMENTS

| | | | | |
|---|---|---|---|---|
| 5,487,234 | A * | 1/1996 | Dragon | F41A 17/06 340/571 |
| 5,530,355 | A * | 6/1996 | Doty | G01R 33/385 324/318 |
| 6,474,011 | B1 * | 11/2002 | Sato | F41A 17/02 42/70.08 |
| 6,601,332 | B1 * | 8/2003 | Riebling | F41A 17/54 42/70.11 |
| 9,970,725 | B2 * | 5/2018 | Kiyani | F41A 17/063 |
| 2015/0007481 | A1 * | 1/2015 | Houde-Walter | F41G 1/35 42/114 |
| 2015/0075054 | A1 * | 3/2015 | Barger | F41G 11/003 42/90 |

* cited by examiner

*Primary Examiner* — Stephen Johnson
(74) *Attorney, Agent, or Firm* — Sanchelima & Associates, P.A.; Christian Sanchelima; Jesus Sanchelima

(57) ABSTRACT

An electronic lock controlled by a solenoid for mounting accessories to a firearm that can be selectively and remotely actuated by an authorized user so that the accessory cannot be removed without the consent of the user. Further features of the present invention include a firearm accessory being locked electronically to a firearm that includes cameras, round frequency detection, lasers, lights, speakers, microphones sensors, GPS, Bluetooth, NFC, Wi-Fi, cellular, and/or microphones and the like.

9 Claims, 19 Drawing Sheets

ELECTRONIC LOCK FOR MOUNTED FIREARM ACCESSORIES

OTHER RELATED APPLICATIONS

The present invention is a U.S. Non-Provisional Patent Application claiming priory of U.S. Provisional Patent Application Ser. No. 62/567,447 filed on Oct. 3, 2017, which is hereby incorporated by reference.

BACKGROUND OF THE INVENTION

Field of the Invention

The present invention relates to a lock and, more particularly, to a lock that can be remotely locked and unlocked to removably mount a firearm attachment to a firearm. The present invention can allow users to monitor the activity of a selected firearm during various activities without the user of the firearm being able to remove or disable an accessory mounted to the firearm.

Description of the Related Art

Several designs for mounting firearm accessories to firearms have been designed in the past. None of them, however, include a lock that can be remotely controlled by a user to engage or disengage to allow users to control whether the accessory is attached to the firearm.

Applicant believes that a related reference corresponds to mechanical locks that uses screws and/or spring-loaded pins to attach a firearm accessory to a firearm. However, these mechanical embodiments known in the art are vulnerable to fatigue of the mechanical components and cannot be remotely and selectively engaged and disengaged.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a lock for mounting firearm accessories that can be remotely engaged or disengaged by a user.

It is another object of this invention to provide an electronic lock for mounting firearm accessories that is rugged and waterproof and be able to provide a reliable engagement in various types of environments.

It is still another object of the present invention to provide an electronic lock that cannot be accessed from the external face of the mounting member so that unauthorized users cannot open the lock without breaking and disabling the firearm.

It is another object of the present invention to provide a firearm accessory that is locked to the weapon and records the frequency that the weapon is discharged, the time and date of various events related to the weapon such as when it is fired or moved, the location of the weapon, and a recording of what the camera on the accessory is recording in real-time.

It is yet another object of this invention to provide such an electronic lock that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
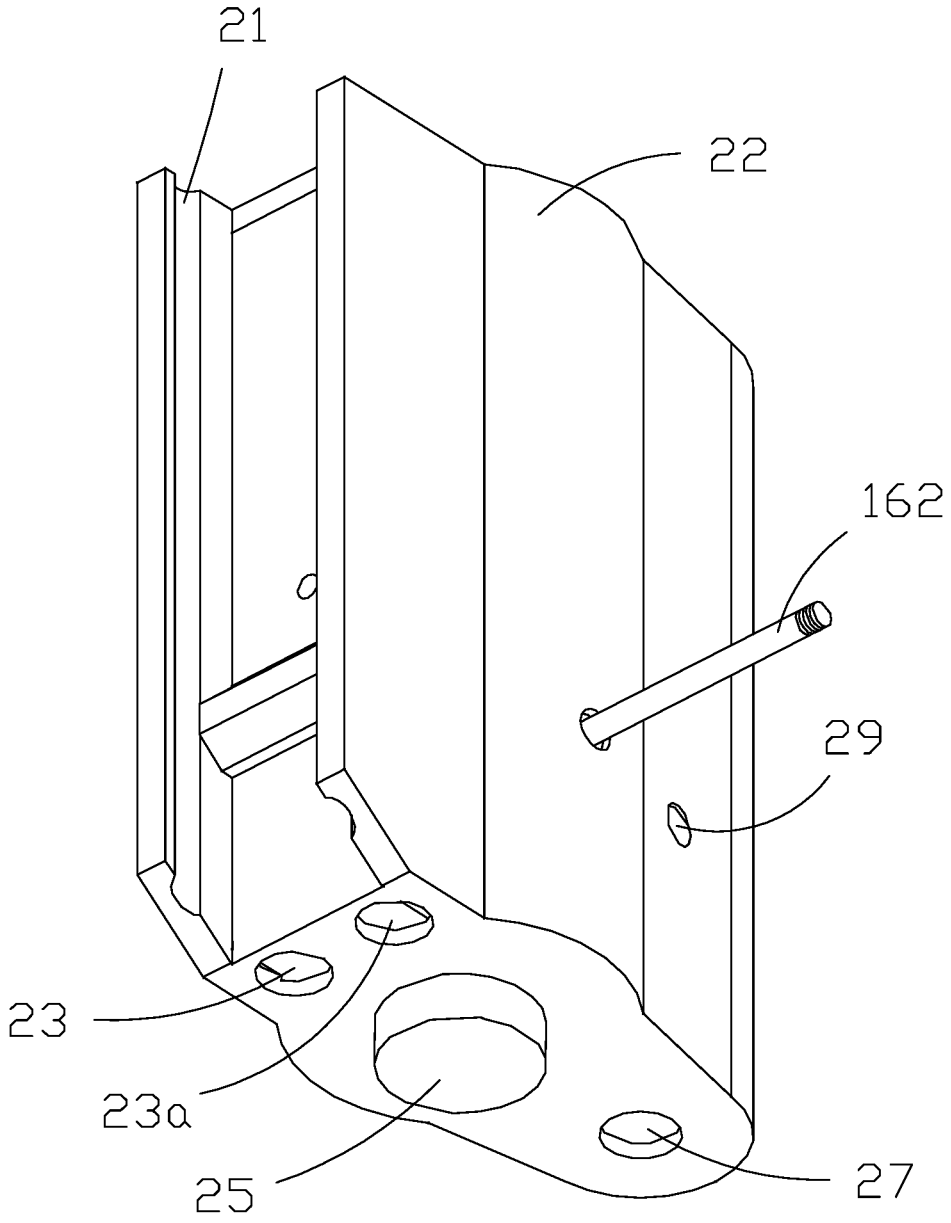
FIG. 1 represents an isometric view of the present invention.
Figure 2:
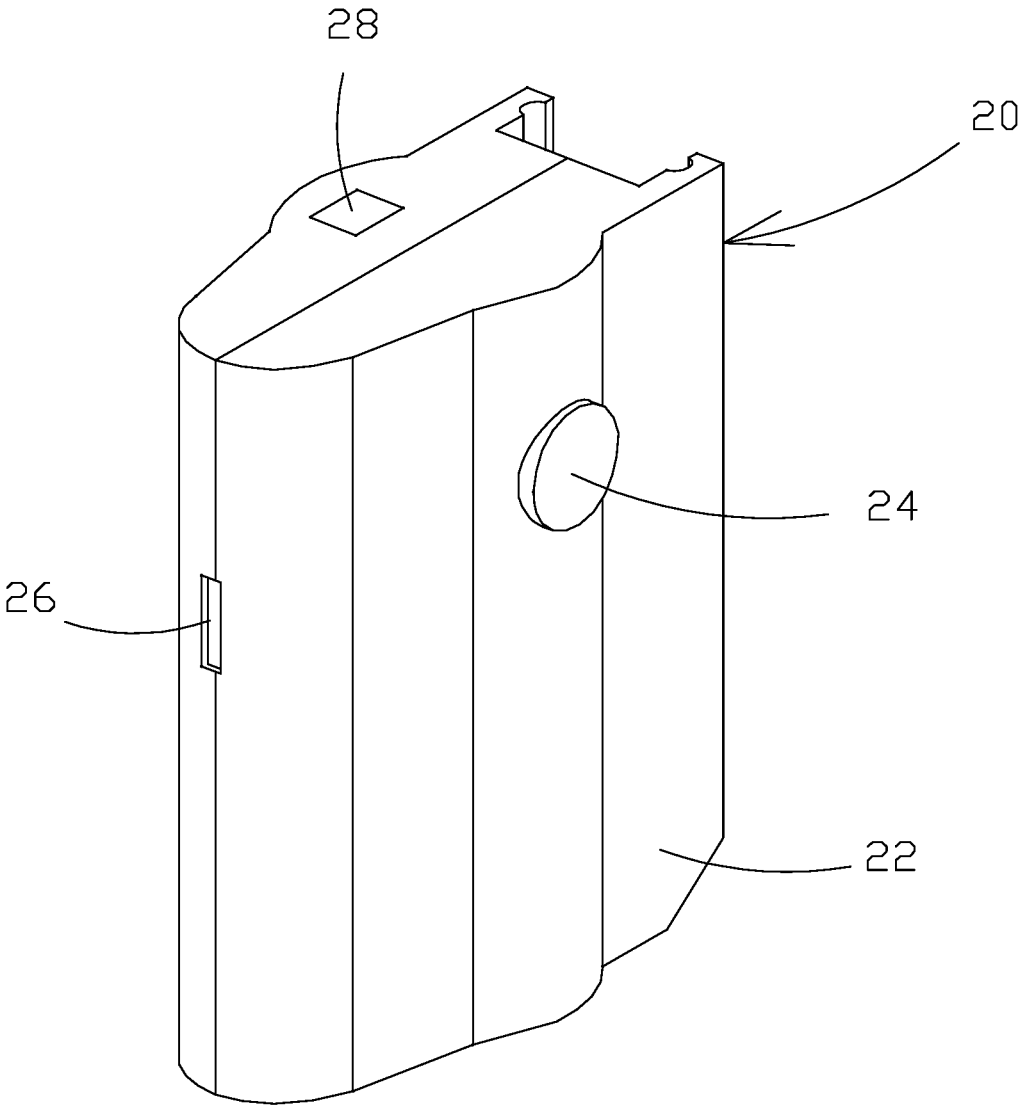
FIG. 2 shows a bottom isometric view of the present invention.
Figure 3:
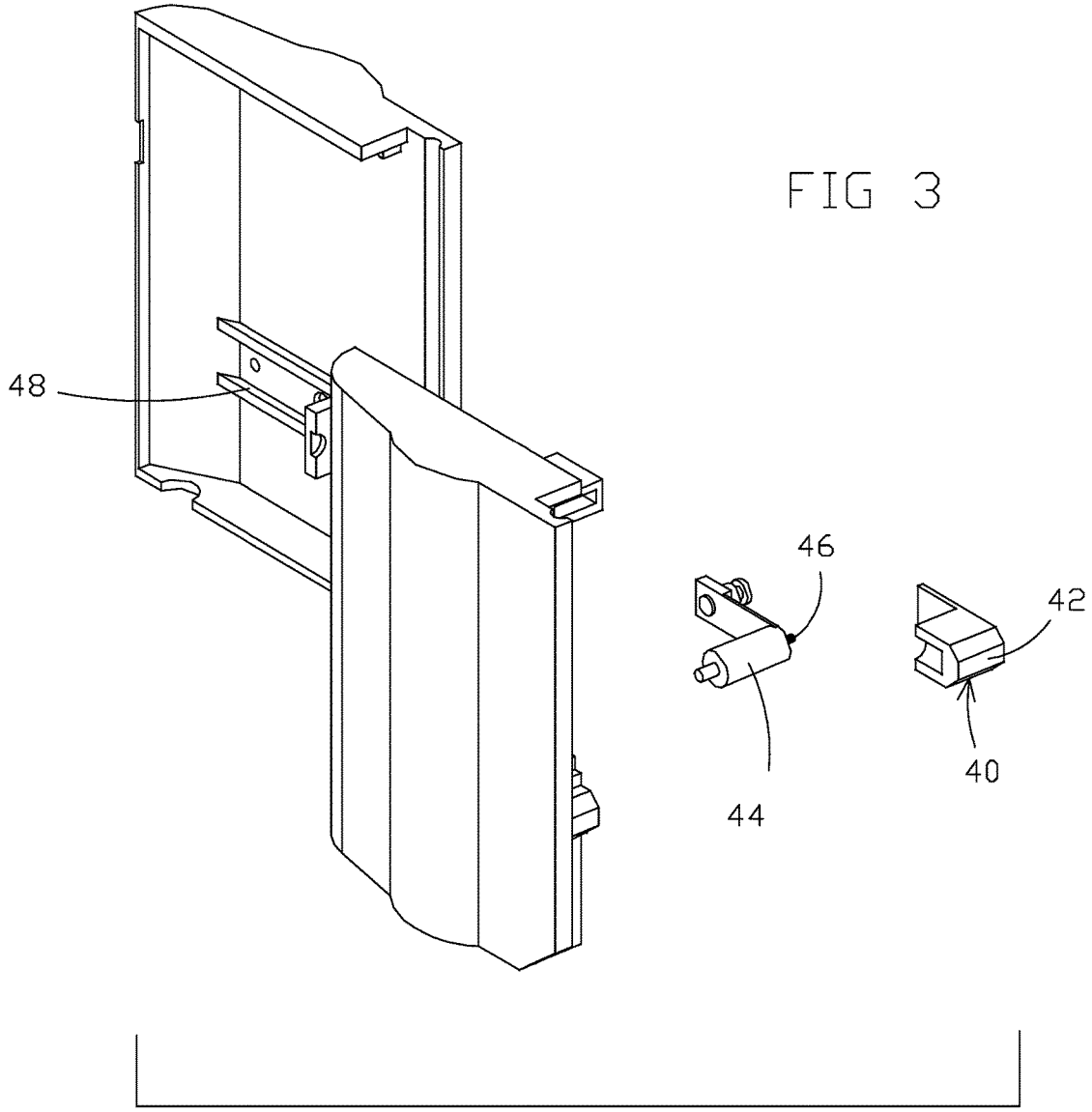
FIG. 3 illustrates an exploded view of the present invention.
Figure 3A:
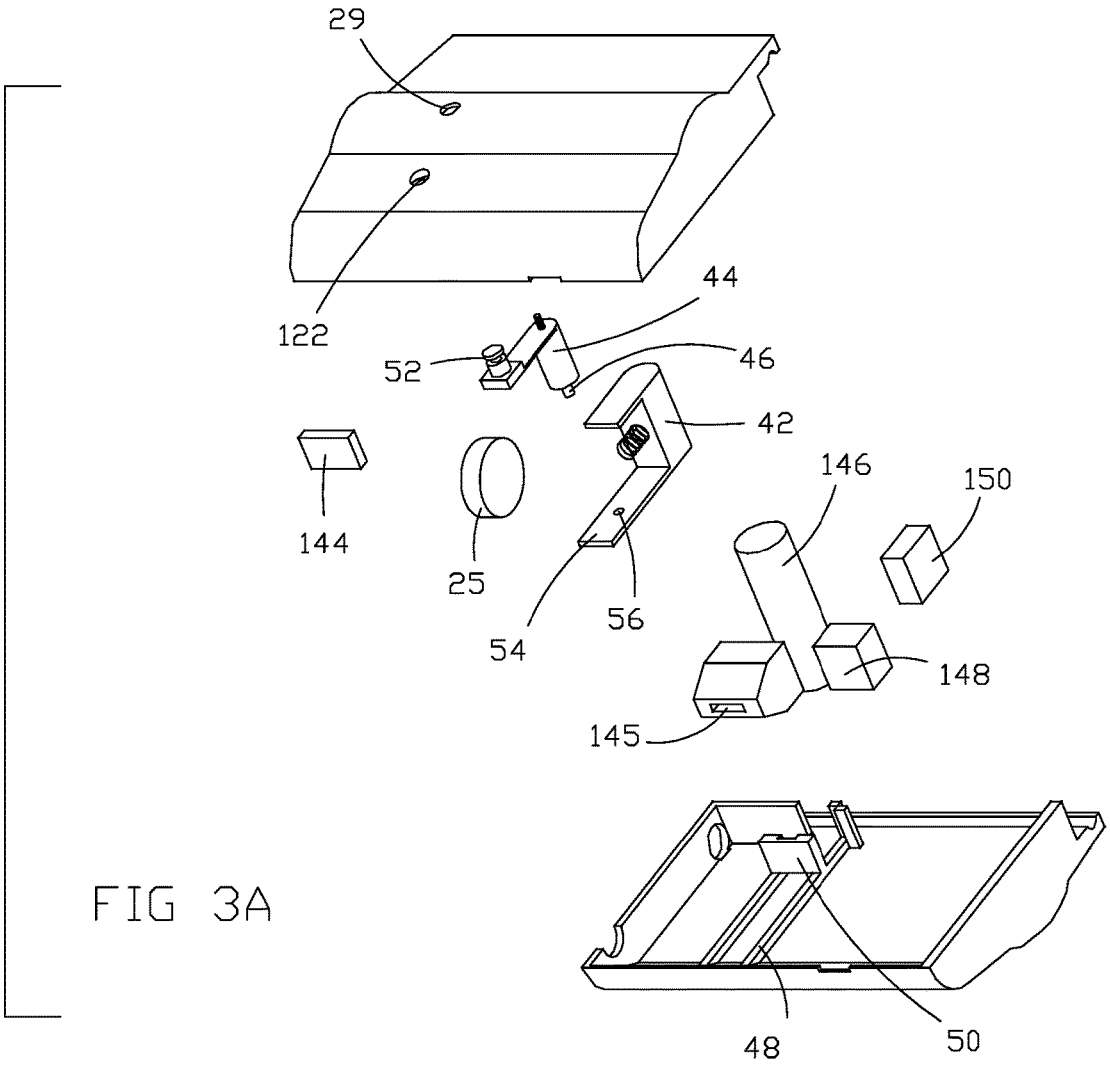
FIG. 3A illustrates an exploded view of the present invention.
Figure 4:
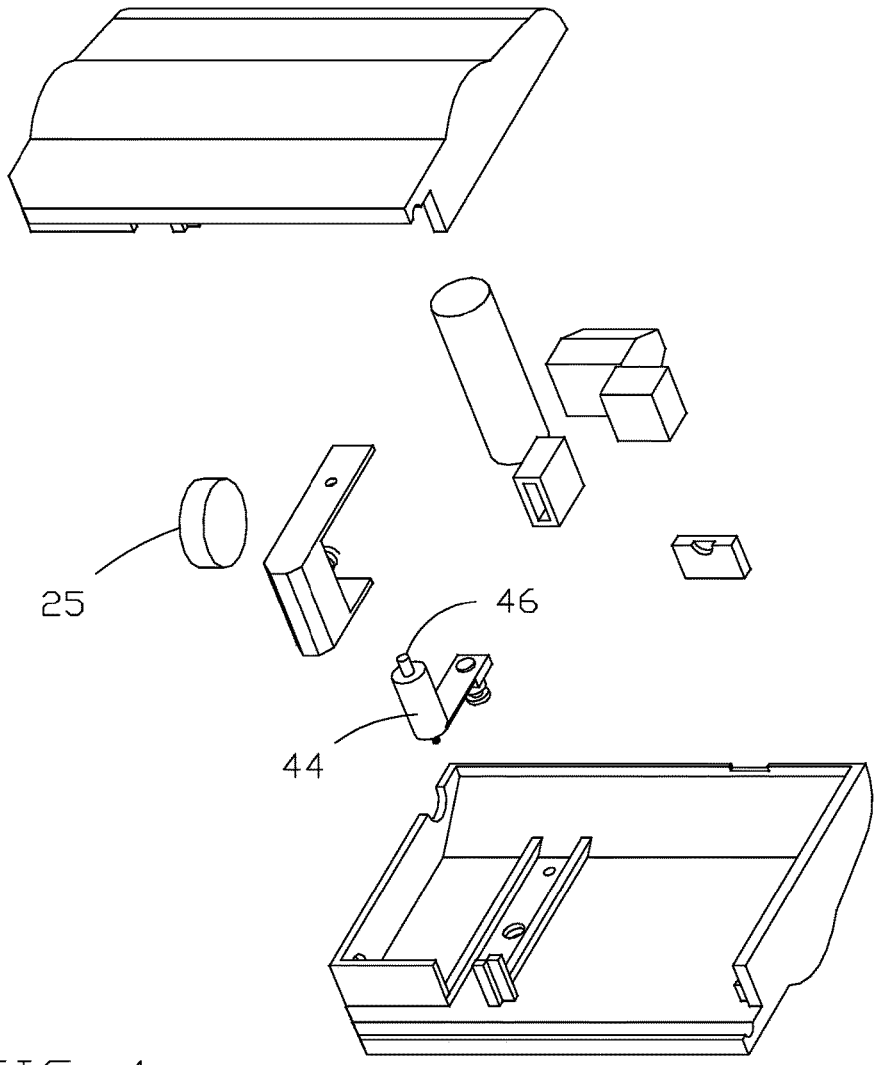
FIG. 4 represents an exploded view of the present invention.
Figure 5:
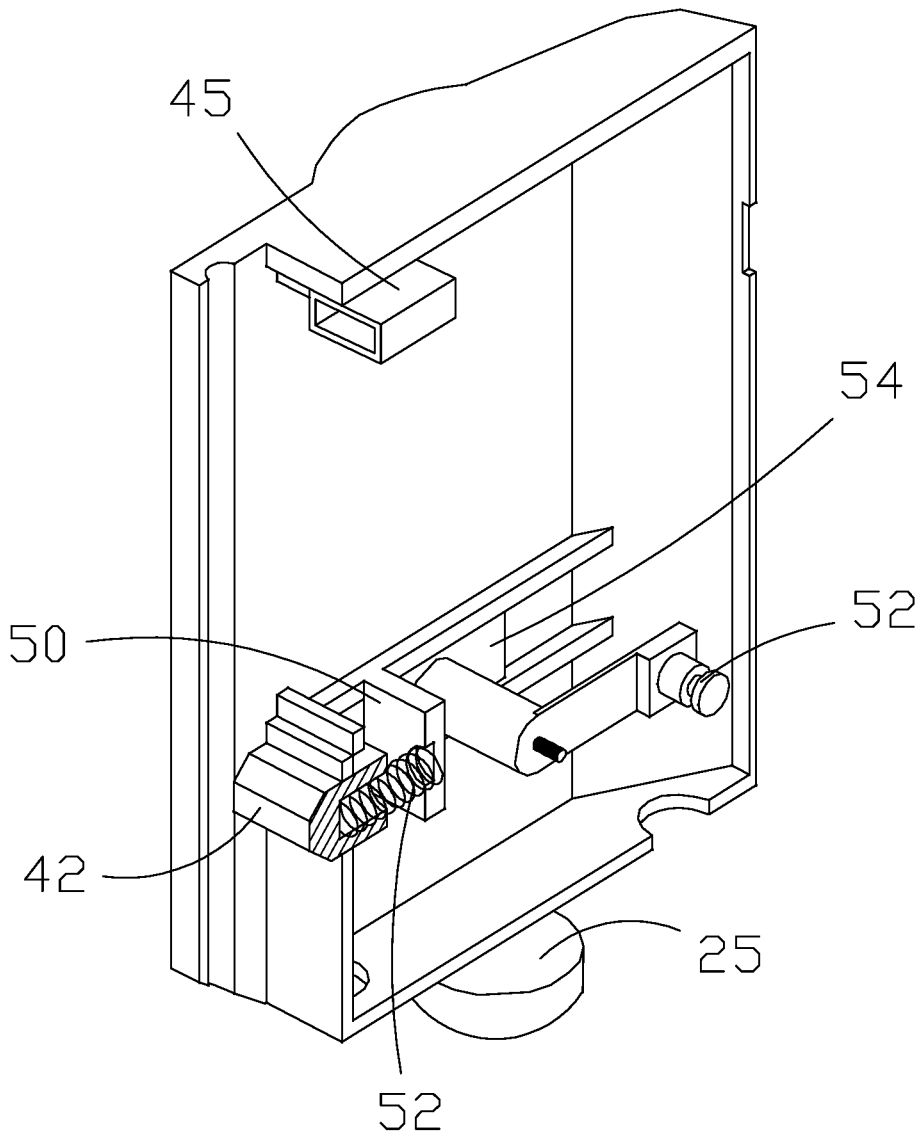
FIG. 5 represents an isometric view showing the components inside the present invention.
Figure 6:
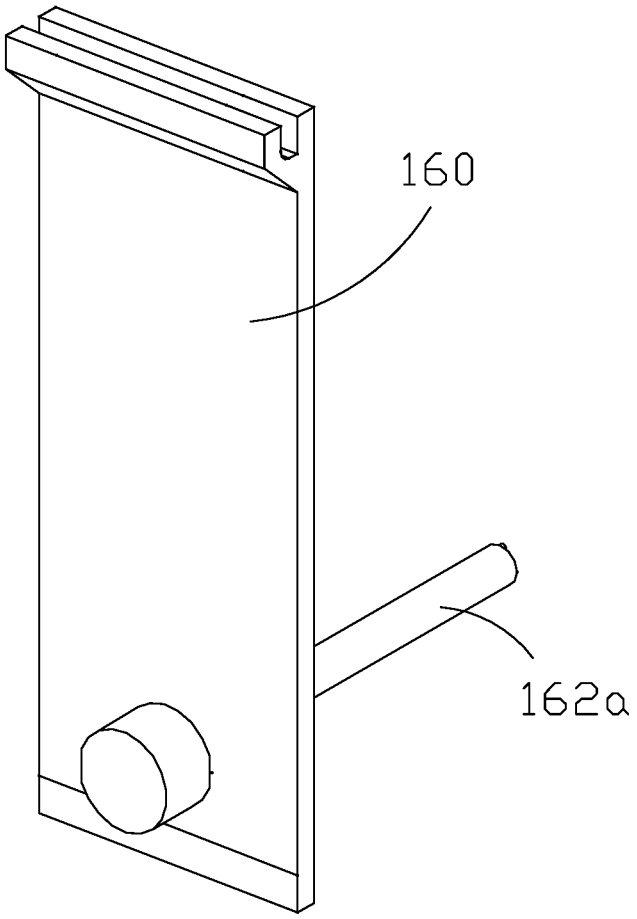
FIG. 6 shows an isometric view of cover 160.
Figure 7:
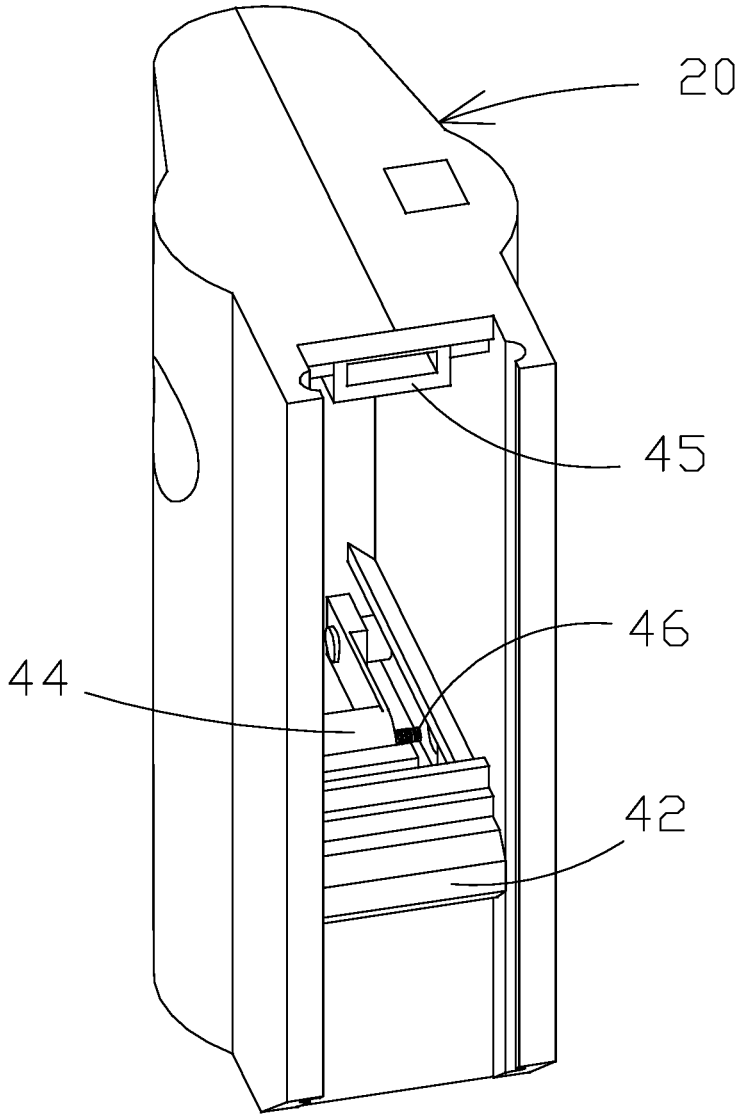
FIG. 7 illustrates a top isometric view of the present invention.
Figure 8:
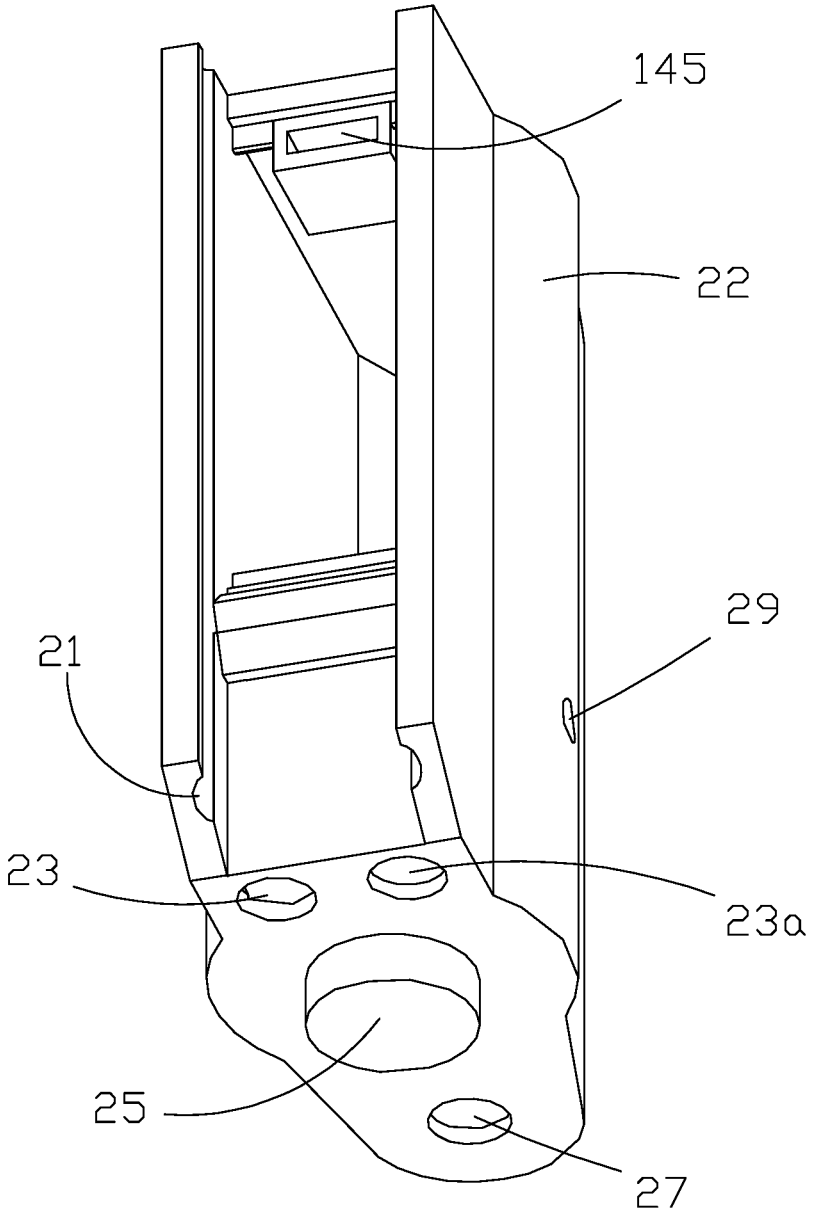
FIG. 8 shows a top isometric view of the present invention.
Figure 9:
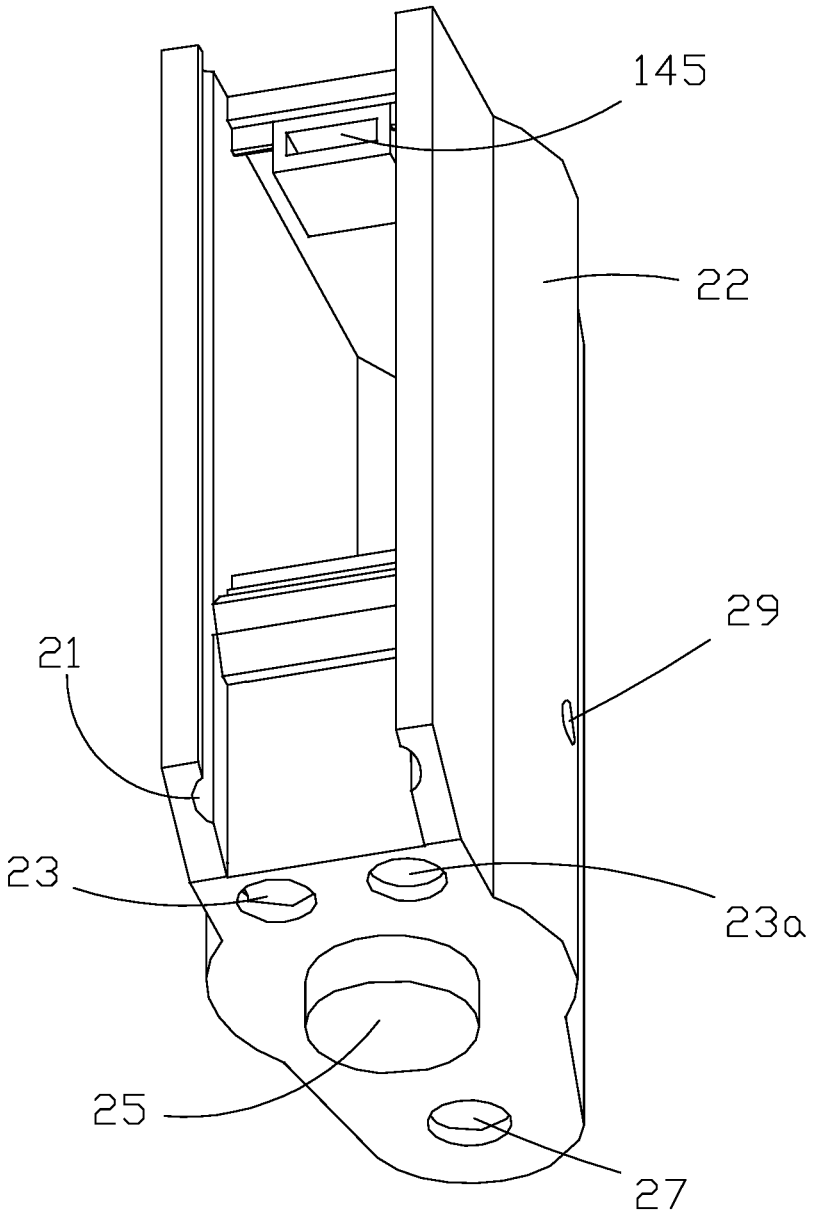
FIG. 9 represents a top isometric view of the present invention.
Figure 10:
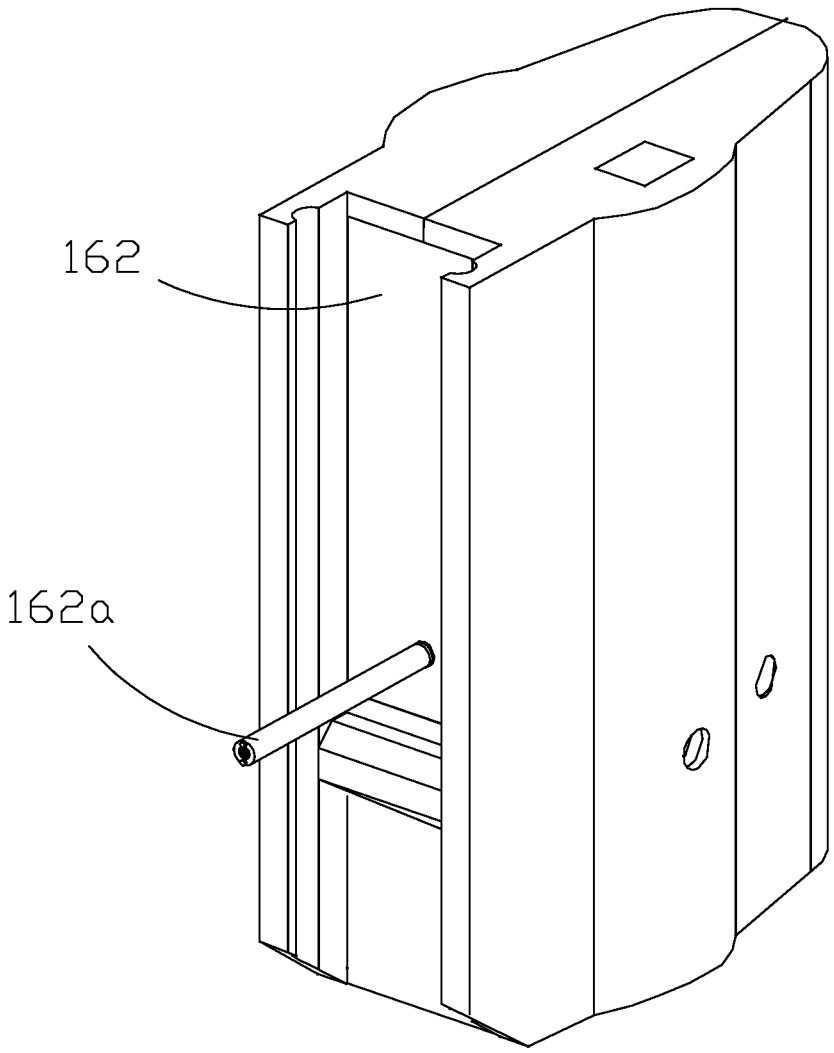
FIG. 10 illustrates a side isometric view of the present invention.
Figure 11:
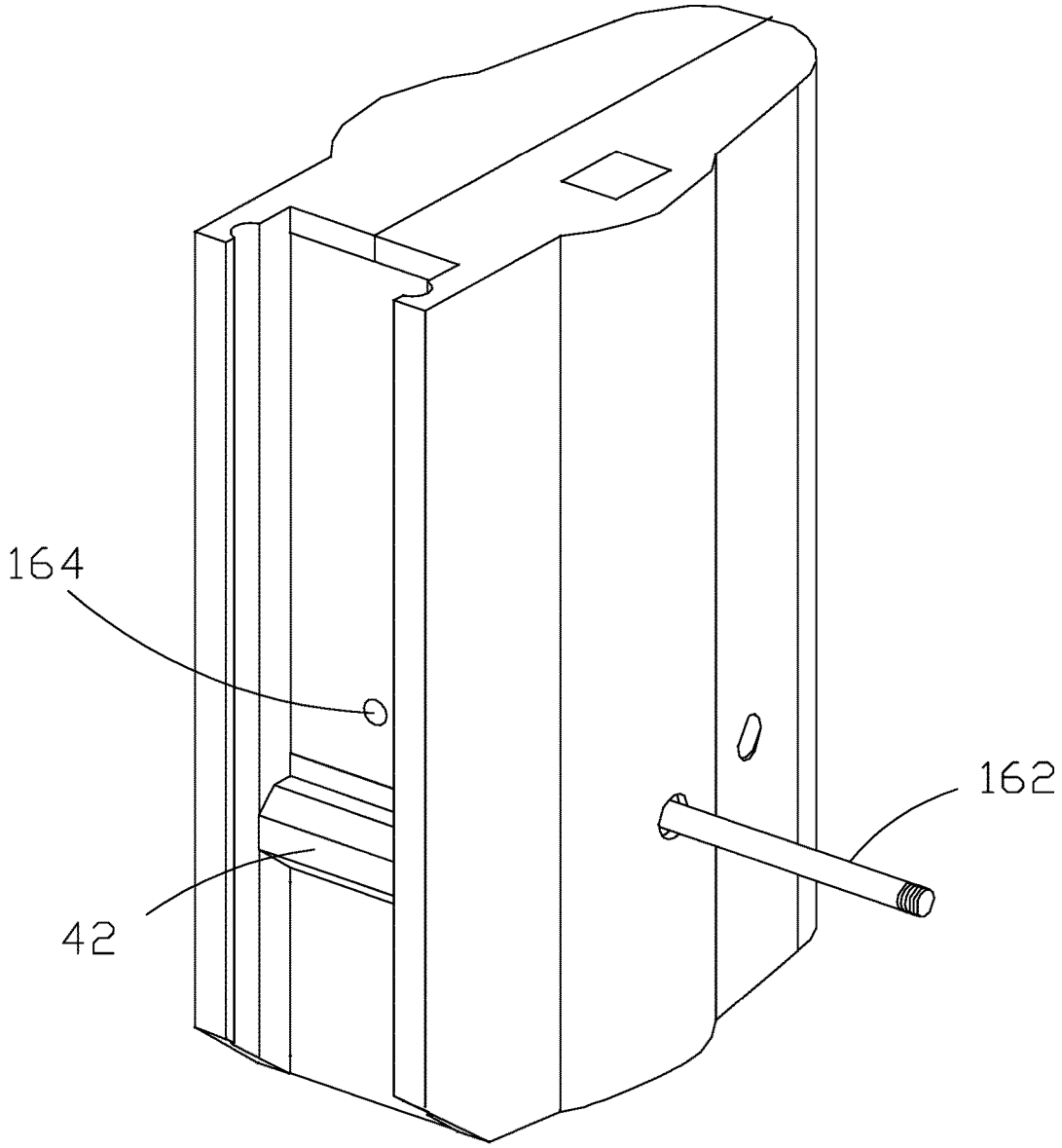
FIG. 11 is a representation of a side isometric view of the present invention.
Figure 12:
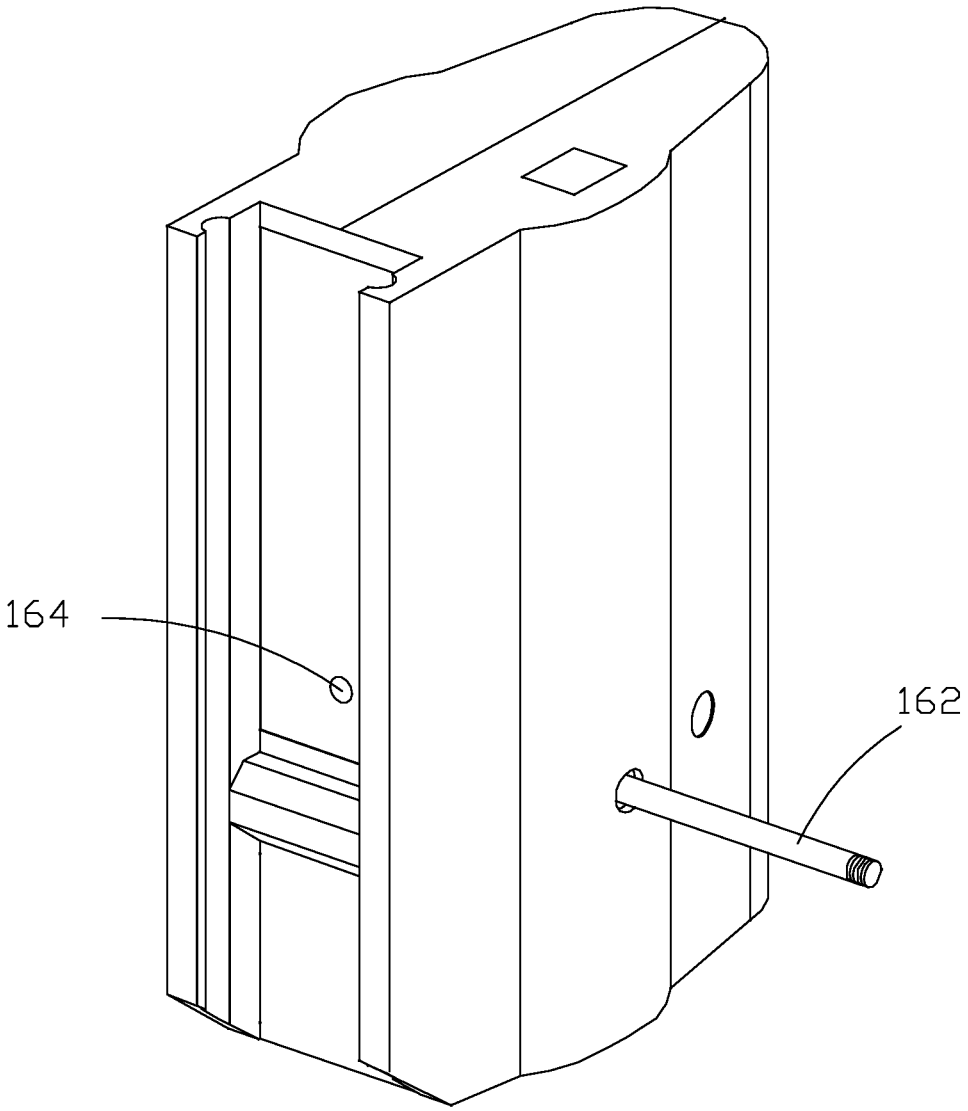
FIG. 12 illustrates a side isometric view of the present invention.
Figure 13:
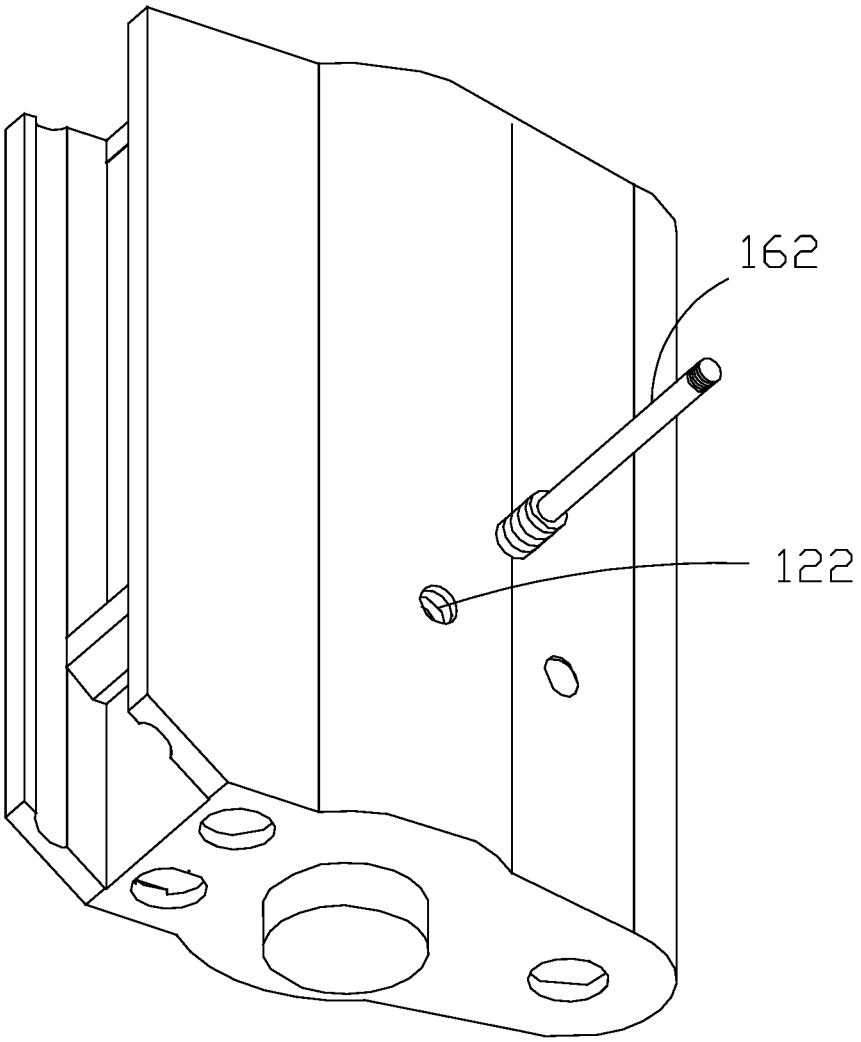
FIG. 13 shows a side isometric view of the present invention.
Figure 14:
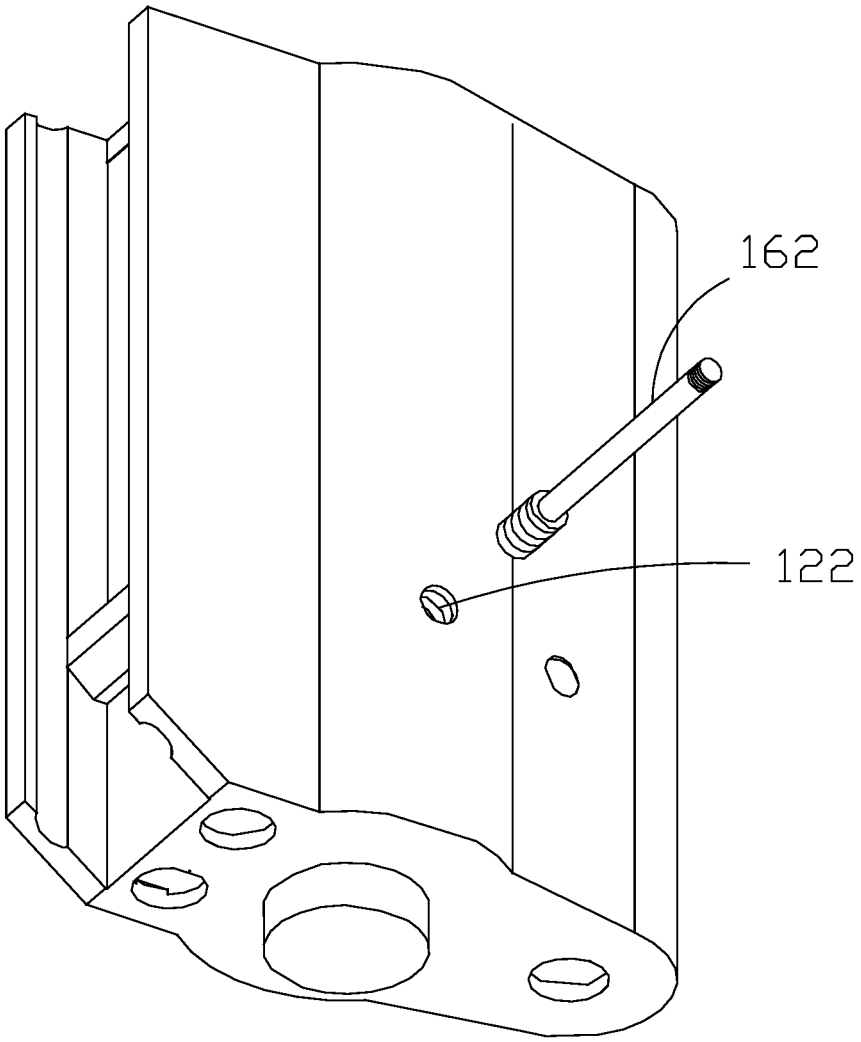
FIG. 14 represents a side isometric view of the present invention.
Figure 15:
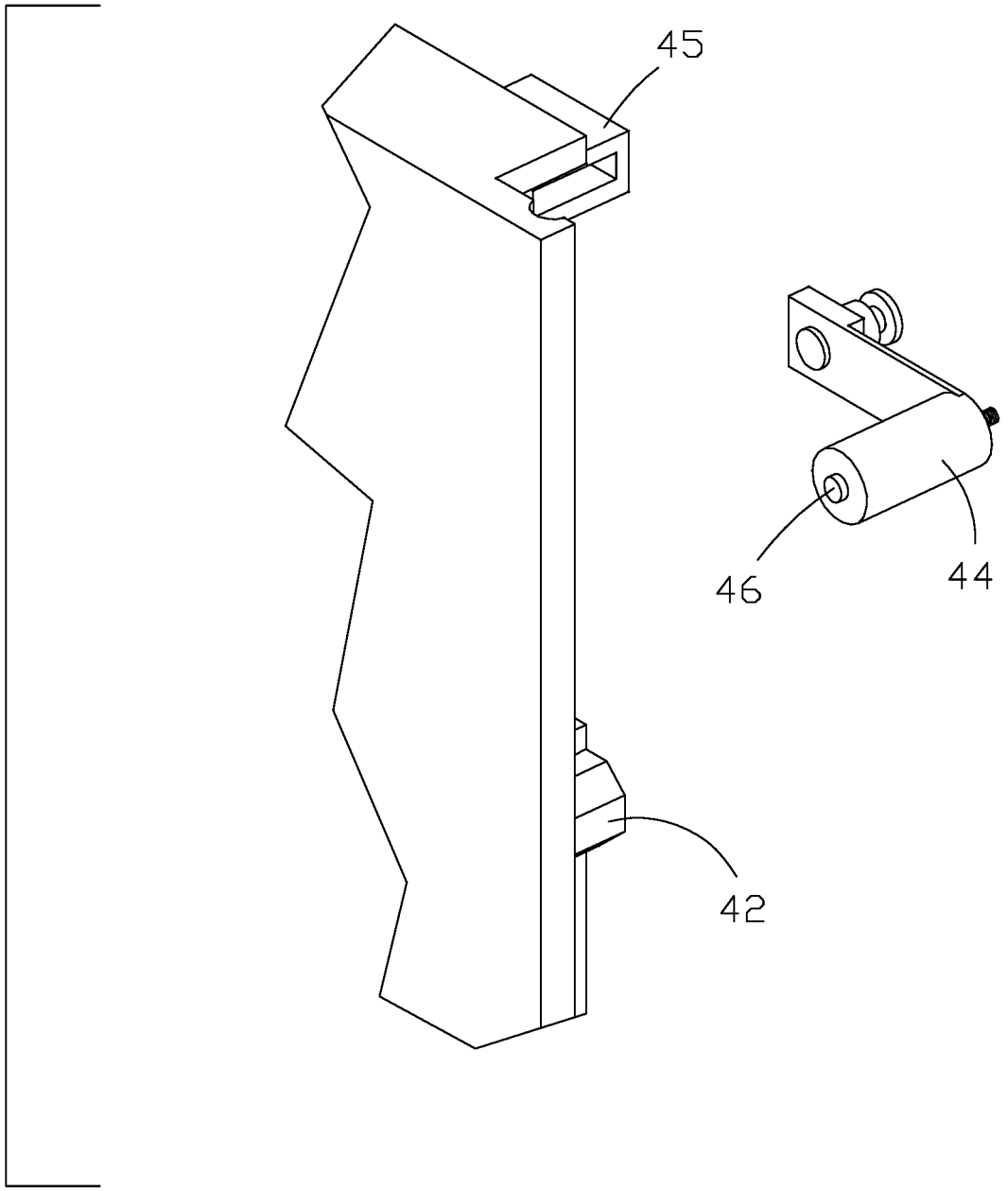
FIG. 15 shows a partial and exploded view of the present invention.
Figure 16:
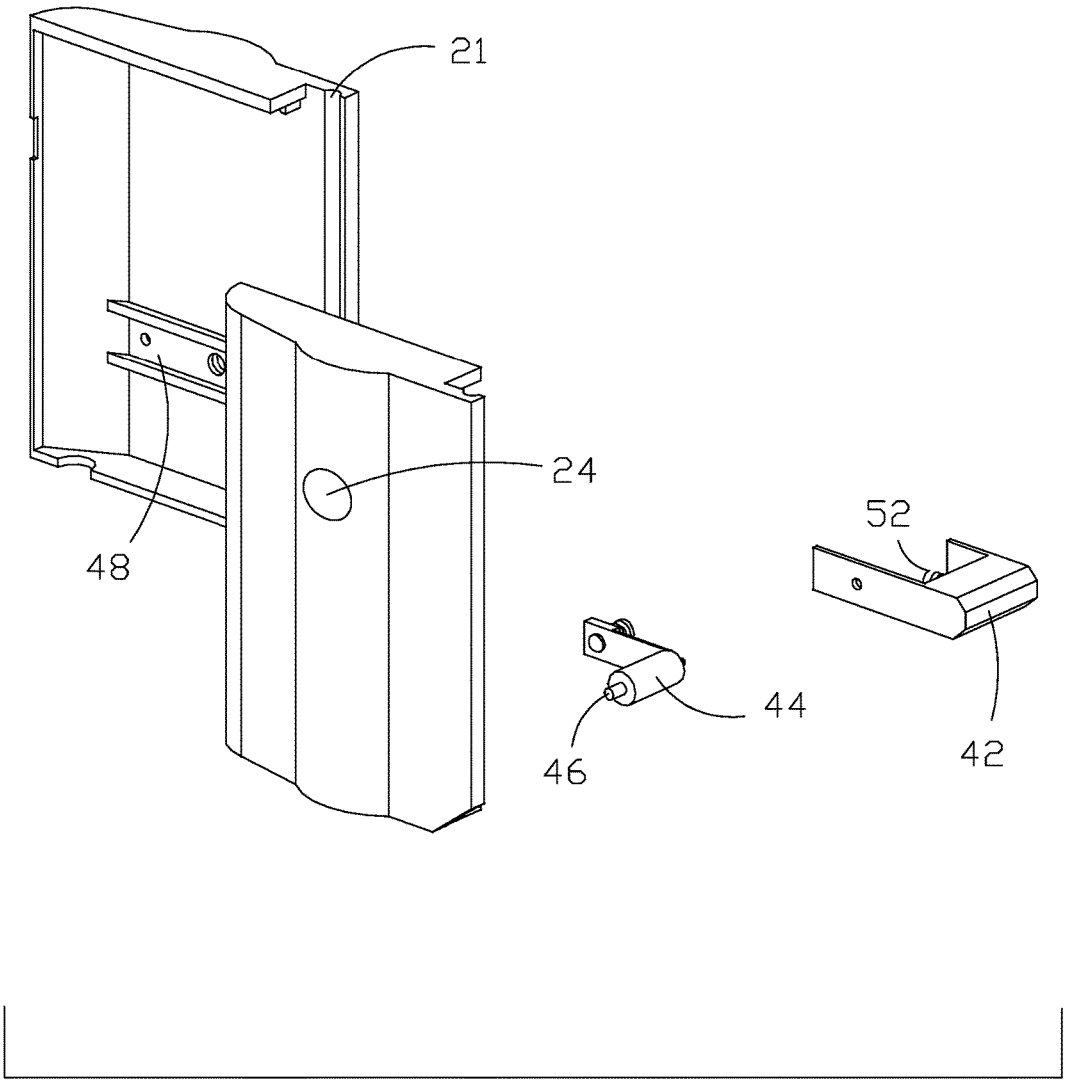
FIG. 16 illustrates an exploded view of the present invention.
Figure 17:
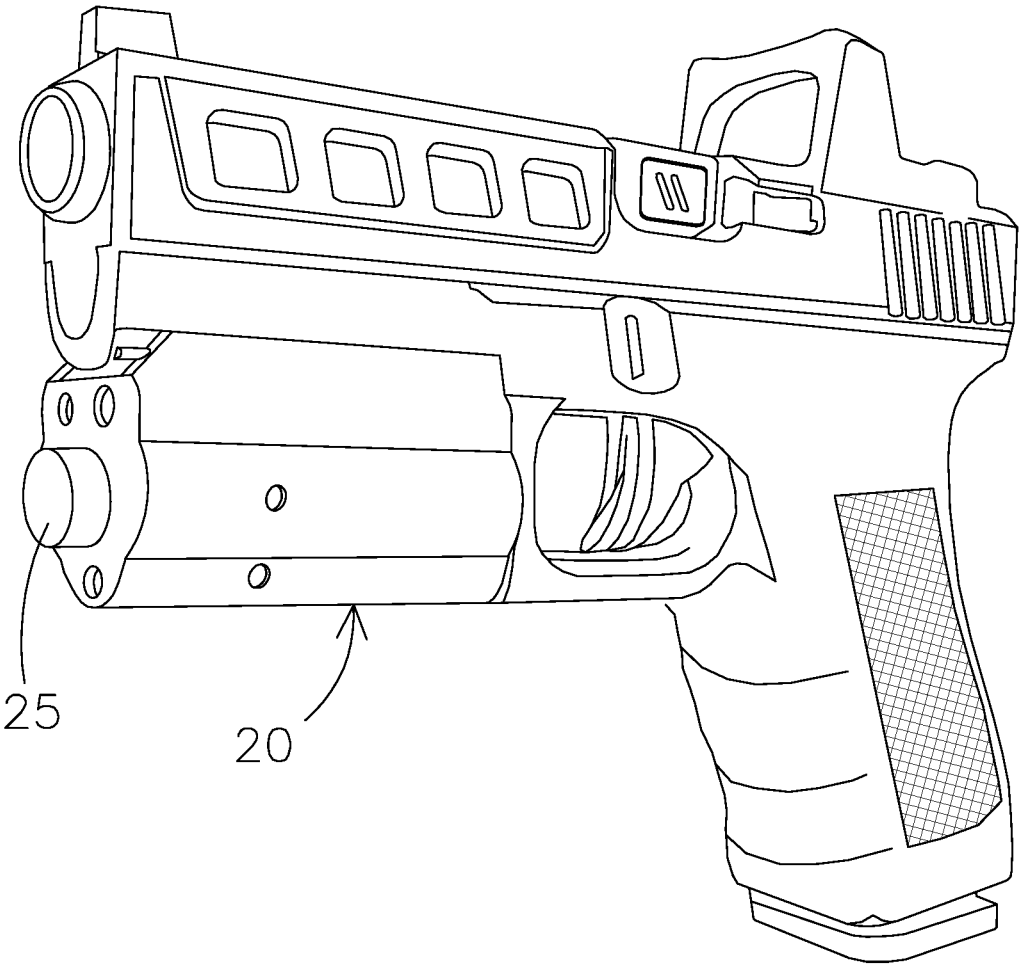
FIG. 17 shows the present invention mounted to a firearm.
Figure 18:
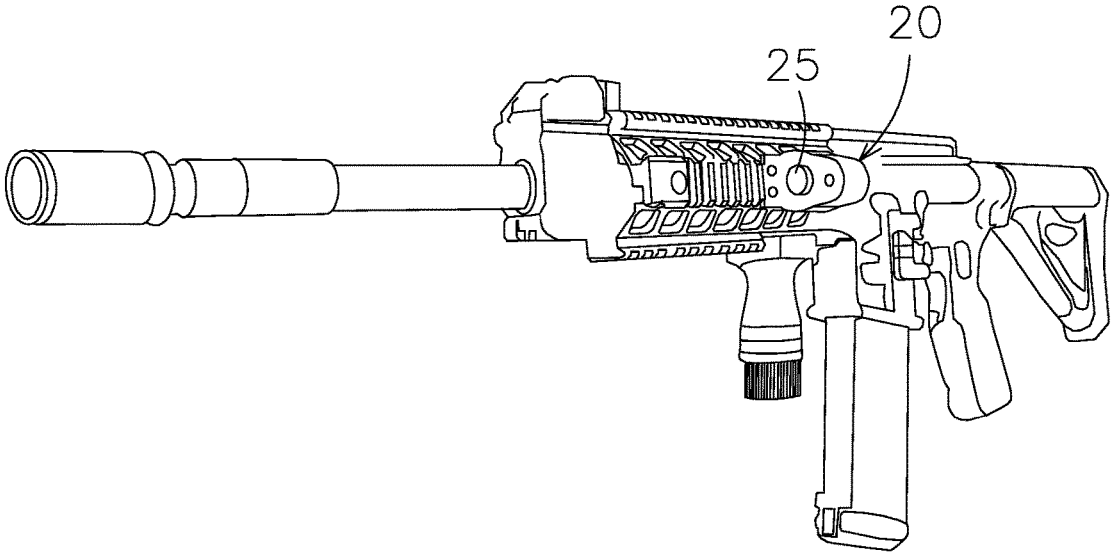
FIG. 18 shows the present invention mounted to a different firearm than the one shown in FIG. 17.

Referring now to the drawings, where the present invention is generally referred to with numeral 10, it can be observed that it basically includes an firearm accessory assembly 20 and an electronic lock assembly 40.

Firearm accessory assembly 20 includes housing 22 that includes mounting carriage 21 on its top side that is inserted into the rail of a weapon to mount the present invention onto a firearm. Housing 22 also includes a distance camera 23 and a short distance camera 23*a* on its front end. The front end of housing 22 can also include a light 25, a laser 27 and a microphone 121. One of the sides, either left or right, of housing 22 can include a first and/or second actuating button 24; 29, respectively, used to control long distance camera 23, short distance camera 23*a*, light 25, laser 27, speaker 28 and/or microphone 121. In one embodiment, speaker 28 can be located on the rear face closer to the user and microphone 121 can be located on the front face closer to the barrel of the weapon. Either the left or the right side of housing 22 can also include key 162 that is inserted into keyhole 122 to manually disengage electronic lock assembly 40. Housing 22 can also include micro USB port 26 to be used to charge battery 146 that powers electronic lock assembly 40. The top of housing 22 includes a cover 160 that covers the internal components that make up electronic lock assembly 40. Also, cover 160 can be opened using cover key 162*a* that is inserted into cover keyhole 164 to open and close cover 160. Cover 160 also covers micro SD slot 145 located inside housing 22 that can receive micro SD 144.

Electronic lock assembly 40 includes electronic lock 42 that is engaged between the grooves of the firearm railing to lock the firearm accessory assembly 20 to the firearm. Lock member 42 is urged upwards in its default position by spring 52 thereby pushing lock member 42 constantly against the rail of the firearm. Spring 52 can be positioned under lock member 42 and partially covered by lock shaft 54 that can be in a perpendicular relationship to electronic lock 42. Lock shaft 54 includes solenoid locking pin slot 56 that receives solenoid locking pin 46 that is connected to solenoid 44.

Solenoid 44 is attached to the inside of housing 22 using fastening member 52. Battery 146 can be connected to processor 148 and antenna 150 that upon processor 148 receiving a signal through antenna 150 activates the battery to provide current to solenoid 44 which in turn caused solenoid locking pin 46 to be retracted out of locking pin slot 56 allowing lock shaft 54 to freely travel up and down. This allows locking member 42 to manipulate the grooves and spring 52 becomes a suspension system for the locking member 42 to rise and fall as it exits each groove to eventually release firearm accessory assembly 20 from the firearm. As locking member 42 overcomes the grooves of the firearm railing it is limited by stopper 50 located on lock shaft member carriage 48 from further downward movement.

The signal to processor 148 can be sent from a mobile application located on a computer, tablet, phone, smartwatch, or similar device. Firearm accessory assembly 20 can be further include GPS, geo-tracking, timestamping, and the like. Firearm accessory assembly 20 can also include a computer processing unit (CPU) that processes and control ultra high definition images and video, audio files, and the like. Firearm accessory assembly 20 can also include transmitting members such as Bluetooth, Wi-Fi, Near-Field Communication, radio frequency, or cellular transmitter.

Firearm accessory assembly 20 can include illumination means such as a flashlight or night vision, lasers, and the like. There can also be a speaker mounted therein that transmits sounds including voices or other alerts. The firearm accessory assembly 20 can include two or more cameras to provide viewing range of short to long distance or 3D footage. The firearm accessory assembly 20 can also include voice recognition and alert users of low battery within the device. The device can include outlets and/or ports to allow for HDMI, mini-HDMI, DVI, micro-USB, USB or similar connections or to charge the battery therein, similar to a phone connection to charge a phone battery. An SD storage can be included with the ability to provide wireless streaming of the content being recorded by the cameras.

The present invention can be adapted to universally work with any firearm. The electronic lock member 42 can be actuated or unlocked using activation or deactivation codes given to the authorized users. The present invention can include motion sensors that notify remote users if the firearm was moved without the user's consent. In one embodiment, the device can include global positioning system (GPS) to inform remote users as to the whereabouts of the firearm.

The present invention can house all of its components related to geo-positioning, GPS, geo-tracking, date/time recording, a battery and related elements within housing 22. Users can unlock the firearm accessory using the electronic lock or manually by using key member 162 that cooperates with a side opening to unlock the accessory from the firearm and a top cover 160 to provide access to the internal components.

The present invention is a rugged, reliable, shockproof, waterproof, all-in-one tactical light, laser, action camera that is mounted or attached to various different types of weapons like pistols, assault rifles, machine guns, rifles, etc. The device is able to record sound, date, time, location, number of rounds fired, and it can also store the information in a micro SD card or similar device. The present invention can also record the frequency of the rounds fired.

The present invention can include fingerprint or similar biometric recognition, night vision, mini USB or similar means to recharge the battery and connect to a computer to transfer information, infrared camera, Bluetooth compatible, Wi-Fi compatible, include a GPS, voice activation, image stabilization, and image rotation. The shooter can engage the target from a cover position by seeing the target on their smartphone or tablet. The attachment can include an electronic lock as described above or a manual key to release the present invention from the weapon and the key can be made custom per unit so that it cannot be used on other devices. Lasers may refer to infrared lasers.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm accessory assembly including an electronic lock that remotely engages and disengages said firearm accessory assembly to a firearm; said firearm accessory assembly includes at least one sensor that detects round fire frequency, date of round fire, time of round fire, location of round fire, or whether said firearm was moved; said firearm accessory assembly further includes a housing having an inner surface and a lock shaft carriage therein that receives a lock shaft and said lock shaft carriage mounts said lock shaft to said inner surface; said lock shaft carriage includes a stopper extending therefrom, said lock shaft is inserted under said stopper and into said lock shaft carriage; said electronic lock includes a locking member, said stopper is adapted to limit downward movement of said locking member.

2. The firearm accessory assembly of claim 1 wherein said electronic lock is mounted to a lock shaft that includes a solenoid locking pin slot that receives a solenoid locking pin to lock said lock shaft in place, said electronic lock urged upwards against a rail using a spring mounted underneath said electronic lock, a solenoid member that when activated pulls said solenoid locking pin out of said solenoid locking pin slot thereby freeing said lock shaft to travel upwards and downwards to allow a user to overcome said rail of said firearm.

3. The firearm accessory assembly of claim 1 wherein said firearm accessory assembly includes lasers, a short distance camera, a long distance camera, a light, a speaker, a microphone, a micro USB port, and/or a micro-SD slot.

4. The firearm accessory assembly of claim 3 wherein said firearm accessory assembly includes a processor and an antenna, said processor adapted to process images captured by said cameras and said antenna is adapted to receive and transmit data and instructions to and from a mobile device.

5. The firearm accessory assembly of claim 1 wherein said firearm accessory assembly includes a housing that includes at least one button adapted to actuate lasers, a short distance camera, a long distance camera, a light, a speaker, a microphone, a micro USB port, and/or a micro-SD slot.

6. The firearm accessory assembly of claim 1 wherein said firearm accessory assembly includes a keyhole that receives a key to manually engage and disengage said firearm accessory assembly from said firearm.

7. The firearm accessory assembly of claim 1 wherein said firearm accessory assembly includes top side having a cover that includes a cover keyhole that receives a cover key that opens and closes said cover.

8. The firearm accessory assembly of claim 1 wherein said locking member has a trapezoidal shape and a rail having a plurality of grooves, said trapezoidal shape adapted to cooperate with traveling through said plurality of grooves.

9. The firearm accessory assembly of claim 1 wherein said firearm accessory assembly includes a carriage that is mounted to a rail, thereby mounting said firearm accessory assembly to said firearm.

* * * * *